US008786404B1

(12) United States Patent
Tillman

(10) Patent No.: US 8,786,404 B1
(45) Date of Patent: Jul. 22, 2014

(54) MULTI-PURPOSE PROTECTION SYSTEM

(76) Inventor: Thomas Tillman, Blairstown, NJ (US)

( * ) Notice: Subject to any disclaimer, the term of this patent is extended or adjusted under 35 U.S.C. 154(b) by 184 days.

(21) Appl. No.: 13/353,466

(22) Filed: Jan. 19, 2012

(51) Int. Cl.
*G08B 5/22* (2006.01)

(52) U.S. Cl.
USPC ..... 340/6.1; 340/501; 73/40.7; 374/21

(58) Field of Classification Search
USPC ..... 340/6.1–6.11, 540–541
See application file for complete search history.

(56) References Cited

U.S. PATENT DOCUMENTS

| | | | | |
|---|---|---|---|---|
| 6,124,790 | A * | 9/2000 | Golov et al. | 340/508 |
| 6,176,401 | B1 * | 1/2001 | Lim | 224/196 |
| D527,055 | S | 8/2006 | Hester | |
| 7,173,534 | B1 | 2/2007 | Markham et al. | |
| 2007/0052536 | A1 | 3/2007 | Hawkes et al. | |
| 2009/0009326 | A1 * | 1/2009 | Veiga, III | 340/541 |
| 2009/0038663 | A1 | 2/2009 | Juslin et al. | |
| 2009/0054023 | A1 * | 2/2009 | Bean et al. | 455/205 |
| 2009/0078216 | A1 | 3/2009 | Bell | |
| 2009/0120374 | A1 | 5/2009 | Hansen | |
| 2009/0305752 | A1 * | 12/2009 | Kim | 455/575.1 |
| 2010/0097207 | A1 * | 4/2010 | Mildenberger et al. | 340/539.11 |
| 2010/0283609 | A1 * | 11/2010 | Remer | 340/541 |
| 2011/0199040 | A1 * | 8/2011 | English et al. | 320/101 |
| 2011/0205057 | A1 * | 8/2011 | Sizemore | 340/568.6 |

* cited by examiner

*Primary Examiner* — Hai Phan
*Assistant Examiner* — Ojiako Nwugo

(57) ABSTRACT

A multi-purpose protection system having a housing, an audio output device on the housing, an alarm activator on the housing, an external detector receptacle on the housing, an external audio output receptacle on the housing functioning to connect an external speaker and allows transmission of audio to the external speaker, a power switch on the housing, a power source housed in a battery compartment in the housing, a microprocessor operatively connected to each the alarm activator, the external detector receptacle, the audio output device, the power source, and the power switch, and a memory component operatively connected to the microprocessor having at least one audio file of a recording of a sound to be emitted when the alarm is activated.

1 Claim, 4 Drawing Sheets

MULTI-PURPOSE PROTECTION SYSTEM

BACKGROUND OF THE INVENTION

Unfortunately, bear (or other predator) attacks are common. Recent examples include a bear attack on two young campers at Stokes State Forest. A woman was killed in Arizona by a black bear digging through a dumpster at a country club. A hiker at Yellowstone National Park was killed by a grizzly bear with two cubs. Other attacks, commonly occur, for example animal attacks on material goods and property.

The present invention features a protection system that emits an audible alarm. The system of the present invention can help a user protect himself or his property from assault by an animal or another individual.

SUMMARY

The present invention features a multi-purpose protection system. In some embodiments, the protection system for providing an alarm sound to deter an attack comprises a housing; an audio output device disposed on the housing; an alarm activator disposed on the housing, the alarm activator can move between at least an inactive position and an active position; an external detector receptacle disposed on the housing, the external detector receptacle can move between an inactive state and an active state; an external audio output receptacle disposed on the housing, the external audio output receptacle functions to connect an external speaker and allows transmission of audio to the external speaker; a power switch disposed on the housing, the power switch can move between an on position and an off position respectively turning on and off the system; a power source housed in a battery compartment disposed in the housing; a microprocessor operatively connected to each the alarm activator, the external detector receptacle, the audio output device, the power source, and the power switch; and a memory component operatively connected to the microprocessor, the memory component comprises at least one audio file of a recording of a sound; wherein when the alarm activator is moved to the activated position the alarm activator sends a first input signal to the microprocessor whereupon the microprocessor sends a first output command to the audio output device and the external audio output receptacle causing the audio output device and the external audio output receptacle to emit the sound from the audio file of the memory component; wherein when the external detector receptacle is moved to the activated state the external detector receptacle sends a second input signal to the microprocessor whereupon the microprocessor sends the first output command to the audio output device and the external audio output receptacle causing the audio output device and the external audio output receptacle to emit the sound from the audio file of the memory component.

In some embodiments, the housing is constructed from a material comprising acrylonitrile butadiene styrene polymer. In some embodiments, the alarm activator is a push button. In some embodiments, the external detector receptacle is a receptacle for a pull pin. In some embodiments, the power source is a battery. In some embodiments, the system further comprises a battery compartment cover temporarily covering the battery compartment. In some embodiments, the system further comprises a solar charger operatively connected to the battery compartment. In some embodiments, the system further comprises a clip disposed on the housing, the clip functions to facilitate attachment of the housing to a person or an object.

In some embodiments, the memory component comprises flash memory, random access memory (RAM), read-only memory (ROM), flash memory, EEPROM, the like, or a combination thereof. In some embodiments, the audio output device includes a transducer that converts electrical signals for the audio file to be emitted as sound waves by the audio output device. In some embodiments, the system further comprises an amplifier operatively connected to the microprocessor and to both the audio output device and the external audio output receptacle.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
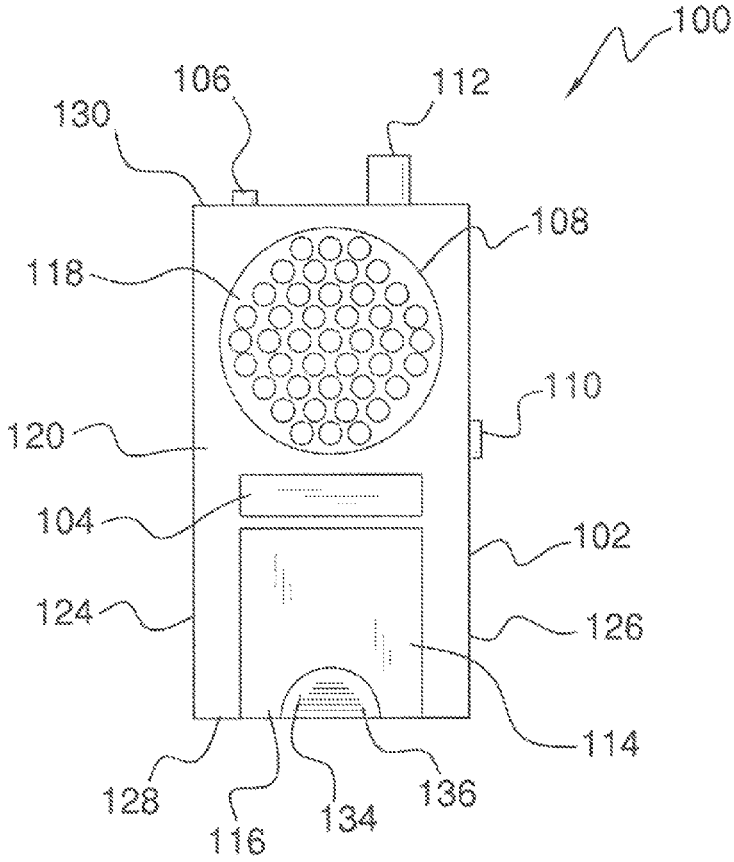
FIG. 1 is a front view of the system of the present invention.

Certain terminology may be used in the following description for convenience only and is not limiting. The words "lower" and "upper" and "top" and "bottom" designate directions in the drawings to which reference is made. The terminology includes the words above specifically mentioned, derivatives thereof and words of similar import.

Where a term is provided in the singular, the inventors also contemplate aspects of the invention described by the plural of that term. As used in this specification and in the appended claims, the singular forms "a", "an" and "the" include plural references unless the context clearly dictates otherwise, e.g., "a battery" may include a plurality of batteries. Thus, for example, a reference to "a method" includes one or more methods, and/or steps of the type described herein and/or which will become apparent to those persons skilled in the art upon reading the disclosure.

Referring now to FIG. 1-4, the present invention features a protection system 100 for deterring an attack or physical assault of an individual or material goods. The system 100 may be used as a protection device in varying situations including, but not limited to, a first individual attacks a second individual; an animal attacks an individual; or an animal assaults material goods such as food, personal possessions, etc. In the event of such an attack, an appropriate loud noise is emitted from the system 100 in order to startle or scare an assailant. That is, the noise emitted by the system 100 deters the assailant from proceeding with the attack. In addition to deterring the assailant, the audible alarm alerts other individuals in the vicinity that such an attack is taking place.

The system 100 comprises a housing 102 having a front surface 120, a back surface 202, side surfaces 124, 126, a top surface 130, and a bottom surface 128 that together form an inner cavity. The housing 102 may be constructed from a variety of appropriate materials. For example, in some embodiments, the housing 102 is constructed from a material comprising acrylonitrile butadiene styrene polymer ("ABS polymer"). The system 100 is not limited to the aforementioned materials. The housing 102 may be constructed in a variety of shapes and sizes. In some embodiments, the housing 102 has a rectangular shape as shown in FIG. 1, however the housing 102 is not limited to a rectangular shape.

An audio output device 108 (e.g., speaker) is disposed on the housing 102, for example on the front surface 120 of the housing 102. The audio output device 108 is adapted to emit an audible alarm when the system 100 is activated. The audio output device 108 may be any speaker capable of emitting sound at the decibel level required to deter an assailant such as an ultra high decibel speaker capable of emitting sound at 105 decibels. Such a speaker may be, but is not limited to, Mini Speaker model No. AS-50 120B08 as manufactured by A & B Components. However, other types of audio output devices may be substituted without departing from the scope of the present invention. Upon activation of the system 100 of the present invention, an audible alarm capable of deterring an assailant is emitted from the audio output device 108.

The system 100 further comprises an alarm activator 104, which may optionally be disposed on the front surface 120 of the housing 102. In some embodiments, the alarm activator 104 is a push button (e.g., the alarm activator 104 can be pressed to an activated position). Push buttons are well known to one of ordinary skill in the art. The alarm activator 104 is not limited to a rectangular shape.

As shown in FIG. 1. In some embodiments, the alarm activator 104 protrudes outwardly from the housing 102 (e.g., the front surface 120). The alarm activator 104 may be relatively large in size and may be easily identified and activated so that a user can easily locate alarm activator 104 and activate the system 100 in the event of an attack or other incident. An attack might include any unwanted physical contact between the user and another individual. For example, if a user is in a public place and a second individual approaches and attempts to assault the user, then that user can activate the system 100 by pressing the alarm activator 104. The alarm activator 104 can move between at least an inactive position and an active position (e.g., not pressed and pressed, respectively), wherein the alarm activator 104 is biased in the inactive position. Pushing the alarm activator 104 moves the alarm activator to the active position, which changes the state of the contact of the alarm activator 104 from open to closed or vice versa to activate the internal components of the system 100, thereby causing an audible alarm to be emitted from the audio output device 108.

In some embodiments, the system 100 further comprises an external detector receptacle 106 disposed on the housing 102, for example on the top surface 130 of the housing 102. The external detector receptacle 106 may facilitate receipt of an alternative alarm input capable of activating the system 100. For example, in some embodiments, the external detector receptacle 106 is a receptacle for a pull pin, for example a a Radio Corporation of America (i.e., "RCA") jack or the like. In some embodiments, the external detector receptacle 106 (e.g., receptacle for a pull pin) is used when a user desires to protect material goods. For instance, if a user desires to deter an attack of a waste receptacle or the like, the external detector receptacle 106 may be set up to be activated upon attack of the waste receptacle or a component thereof (e.g., the lid). That is, the first end of a pull pin is inserted into external detector receptacle 106 and the second end of the pull pin is coupled to the first end of a cord by tying the end of the cord to a loop porting passing through a small aperture located adjacent to the second end of the pull pin. A cord may be any appropriate elongated material such as, but not limited to, rope, twine, fishing line, etc. The second end of the cord is coupled to the waste receptacle or a component thereof. In the event that the waste receptacle is assaulted, the waste receptacle will move, thereby pulling the second end of the cord. In turn, tension will be placed on the first end of the cord causing the pull pin to be removed from the external detector receptacle 106. When the pull pin is removed from the external detector receptacle 106, the state of the electrical contact changes from closed to open, or vice versa, thereby activating the system 100. Although the external detector receptacle 106 is described herein as a receptacle for a pull pin, other types of external detector receptacles may be substituted without departing from the scope of the present invention.

In some embodiments, the system 100 further comprises an external audio output receptacle 110, which may be disposed on a side surface 124, 126 of the housing 102. The external audio output receptacle 110 functions to connect an external speaker to the system 100. The external audio output receptacle 110 can receive and retain an analog audio connector such as a commonly used TRS connector or speaker jack, which are typically connected to an external speaker via an audio wire. This connection allows the system 100 to transmit audio generated by the system 100 to the external speaker as is typically known in the art. That is, in the event that an external speaker is connected to the external audio output receptacle 110 and the system 100 is activated via the alarm activator 104 or the external detector receptacle 106, an audible alarm is emitted from the external speaker.

An external speaker may be utilized, for example, in the event that the audible alarm emitted by audio output device 108 is not of sufficient volume to effectively deter an assailant, such as in a situation in which the system 100 is not located directly adjacent to the object(s) being protected. For instance, in the embodiment discussed above with reference to the use of the external detector receptacle 106 to protect a waste receptacle, in the event that the user anticipates an assault by an animal such as a bear, the user may desire to preemptively prevent damage to the system 100 by placing the system 100 in a location away from the location of the anticipated assault (e.g., the location of the waste receptacle). That is, if a user desires to protect a waste receptacle but also desires to prevent damage to the system 100, then the user may select a cord of sufficient length to place the system 100 at a sufficient distance from the waste receptacle. If the user selects a cord that is several feet in length and places the system 100 several feet from the waste receptacle, the volume of the audio generated by the audio output device 108 as it is perceived directly adjacent to the waste receptacle may not be of sufficient volume to deter the assailant. In such an event, an external speaker may be placed adjacent to the waste receptacle with wiring of approximately equal length to the cord to provide sufficient audio volume at the location of the waste receptacle. In this scenario, the analog audio connector of the external speaker is coupled to the external audio output receptacle 110 to allow the system 100 to transmit the audio alarm to the external speaker.

The system 100 further comprises a power switch 112, which may optionally be disposed on the top surface 130 of the housing 102. Power switches are well known to one of ordinary skill in the art. The power switch 112 functions to turn on and off the system 100. The power switch 112 can help prevent emission of an accidental alarm from the system 100 when it is not being used. That is, if the power switch 112 is in an off position, the audible alarm will not be emitted from the audio output device 108 if the alarm activator 104 is inadvertently depressed. When the power switch 112 is in the on position, electrical power is provided to the components of the system 100, which allows an alarm to be activated locally or remotely as discussed herein.

Figure 2:
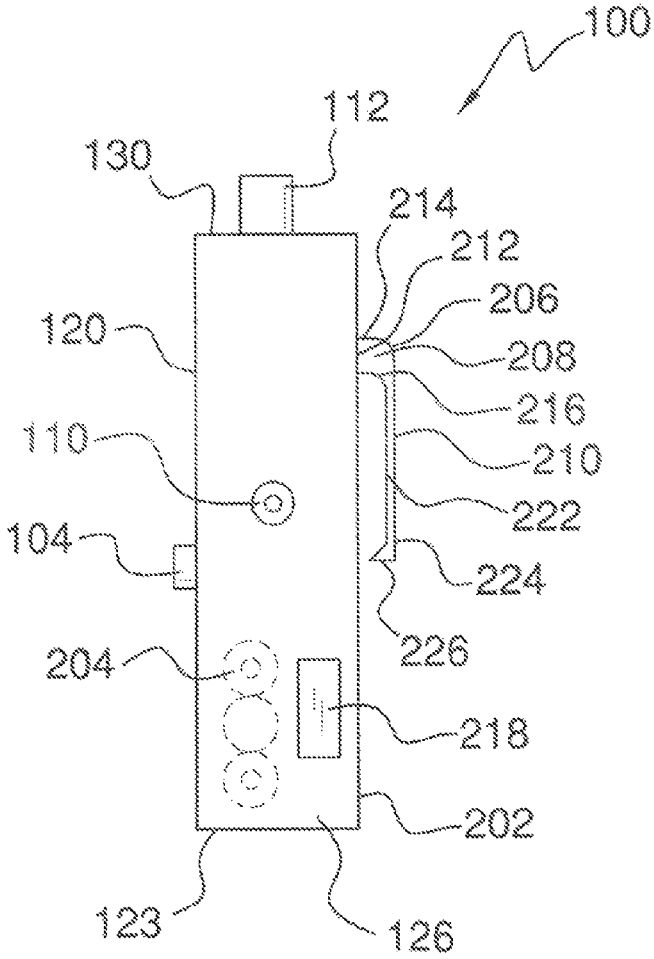
FIG. 2 is a side view of the system of the present invention.

The system 100 comprises a power source (e.g., a battery). The power source is housed in a battery compartment 114 disposed in the housing 102. A battery compartment cover 116 temporarily covers the battery compartment 114. The battery compartment cover 116 may be coupled to the battery compartment 114 using any of a variety of methods as is commonly known in the art including, but not limited to, tabs, clips, and screwed connectors. Battery compartments are well known to one of ordinary skill in the art. For example, the battery compartment 114 comprises appropriate conductive elements (not shown) to supply the system 100 with electrical power drawn from batteries as is commonly known in the art. As shown in FIG. 2, one or more batteries 204 are disposed in the battery compartment 114. In some embodiments, a grip 134 is disposed on the battery compartment cover 116 to facilitate grasping of the battery compartment cover 116 with sufficient friction to remove it form the battery compartment 114. In some embodiments, the grip 134 comprises a plurality of horizontal linear beads 136 that are parallel to one another (and optionally decrease in length from the bottommost bead 136 to the topmost bead 136). The raised nature of beads 136 may provide additional friction required between the hand of the user and the battery compartment cover 116 to uncouple the battery compartment cover 116 from the battery compartment 114.

In some embodiments, the system 100 further comprises a solar charger 218 operatively connected to the battery compartment 114. Solar chargers are well known to one of ordinary skill in the art. For example, the solar charger 218 generates electrical energy from light energy absorbed from the sun and transmits the energy to the batteries 204. The solar charger 218 may provide power to the batteries 204 to extend the life of the batteries 204 as is commonly known in the art.

As shown in FIG. 2, the system 100 may further comprise a clip 206 disposed on the housing 102, e.g., disposed on the back surface 202 of the housing 102. The clip 206 functions to facilitate attachment of the housing 102 to a person or an object. The clip 206 may be any clip of sufficient strength to support the system 100. In some embodiments, the clip 206 has a body 208 with an arm 210. In some embodiments, the body 208 has a vertical surface 212 that is coupled to the back surface 202 of the housing 102 (e.g., via an adhesive or any other method commonly known in the art). In some embodiments, the body 208 has a horizontal upwardly facing surface 214 extending from the topmost end of the vertical surface 212 and a downwardly facing surface 216 extending from the bottommost end of the vertical surface 212.

In some embodiments, the upwardly and downwardly facing surfaces 214, 216 both include downward beveled edges at their outermost ends. These beveled edges facilitate the substantially perpendicular transition from the body 208 and the arm 210. That is, the smooth edges facilitate use of the clip 206 when it is clipped, for example, to a user's clothing by eliminating sharp edges that may catch on or otherwise damage the user's clothing. The arm 210 extends downwardly parallel to the rearward facing surface 202 in a substantially linear manner. The arm 210 includes an inwardly facing surface 222 and an outwardly facing surface 224, which are parallel to one another and to the rearward facing surface 202.

In some embodiments, a bead 226 is disposed at the bottommost end of the arm 210. In some embodiments, the bead 226 is substantially triangular in shape and is provided to prevent or minimize the potential of accidental removal of the clip 206. That is, when the clip 206 is coupled to an article such as a belt, the bead 226 reduces the distance between the rearward facing surface 202 and the inwardly facing surface in contact with such belt. That is, the inwardly facing surface of bead 226 is closer to the rearward facing surface 202 than the inwardly facing surface 222 of the arm 210. Therefore, the bead 226 requires greater movement of the arm 210 relative to the rearward facing surface 202 in order to create the space necessary to pass the belt therethrough for retention of the system 100 on the belt. In turn, a greater distance must be traveled by the arm 210 to create sufficient space for the belt to pass therethrough to remove the system 100 from the belt. Therefore, the bead 226 requires a greater force to dislodge the system 100 from its position coupled to a belt as the force must be of sufficient strength to create sufficient space between the rearward facing surface 202 and the inwardly facing surface of the bead 226 for the belt to pass therethrough. Therefore, in the event that the system 100 is bumped or jostled, the article will be less likely to dislodge from the user (e.g., it is less likely to pass through the space between the bead 226 and the rearward facing surface 202).

The clip 206 allows a user to carry the system 100 in a location that allows him/her to conveniently activate the audible alarm. For instance, the user may elect to couple the clip 206 to his/her belt so that the alarm activator 104 is within easy reach in the event of an assault. Additionally, placement of the system 100 on the user's body and the relatively large size of the alarm activator 104 allows the audible alarm to be activated even if the user is not able to depress the alarm activator 104. That is, if the user is in a public place and another individual assaults the user causing the user to fall to the ground, then the system 100 will be activated if the user falls onto the device. That is, as the user falls to the ground, the relatively large size of the alarm activator 104 will increase the likelihood that it is depressed during the fall. Additionally, coupling the system 100 to a location such as the front of a user's bell increases the likelihood that the alarm activator 104 is depressed during the fall. In some embodiments, in the event that a user falls and is injured and rendered unable to activate the alarm while wearing the system 100, the alarm may also be activated due to the impact with the ground, thereby alerting other individuals in the nearby vicinity to the potential problem to allow them to provide assistance.

Figure 3:
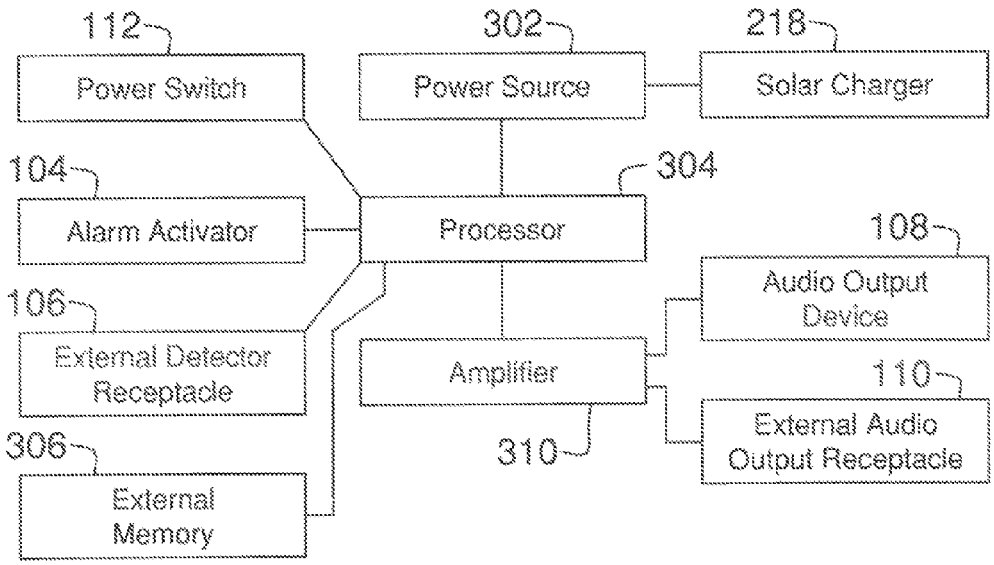
FIG. 3 is a schematic view of the electrical components system of the present invention.

As shown in FIG. 3, the system 100 comprises a microprocessor 304 disposed in the housing 102. The alarm activator 104, the external detector receptacle 106, the audio output device 108, the power source 302 (e.g., batteries 204), and the power switch 112 are each operatively connected to the microprocessor 304.

In some embodiments, the power switch 112 is a maintained switch such as Slim Line Switch model No. 207395K35 as manufactured by McMASTER-CARR®. However, other types of switches may be substituted without departing from the scope of the present invention. The power switch 112 may be wired to a binary input that may have an open status or a closed status. When indexed to the on position, the power switch 112 changes its contact from an open to closed position, or vice versa, thereby changing the status of the binary input at the microprocessor 304 and notifying the microprocessor 304 that the power switch 112 is in the on position. When in the on position, the microprocessor 304 allows an audible alarm to be emitted. When power switch 112 is indexed to the off position, power switch 112 changes its contact from an open to closed position, or vice versa, thereby changing the status of the binary input and notifying the microprocessor 304 that the system 100 should power down.

Figure 4:
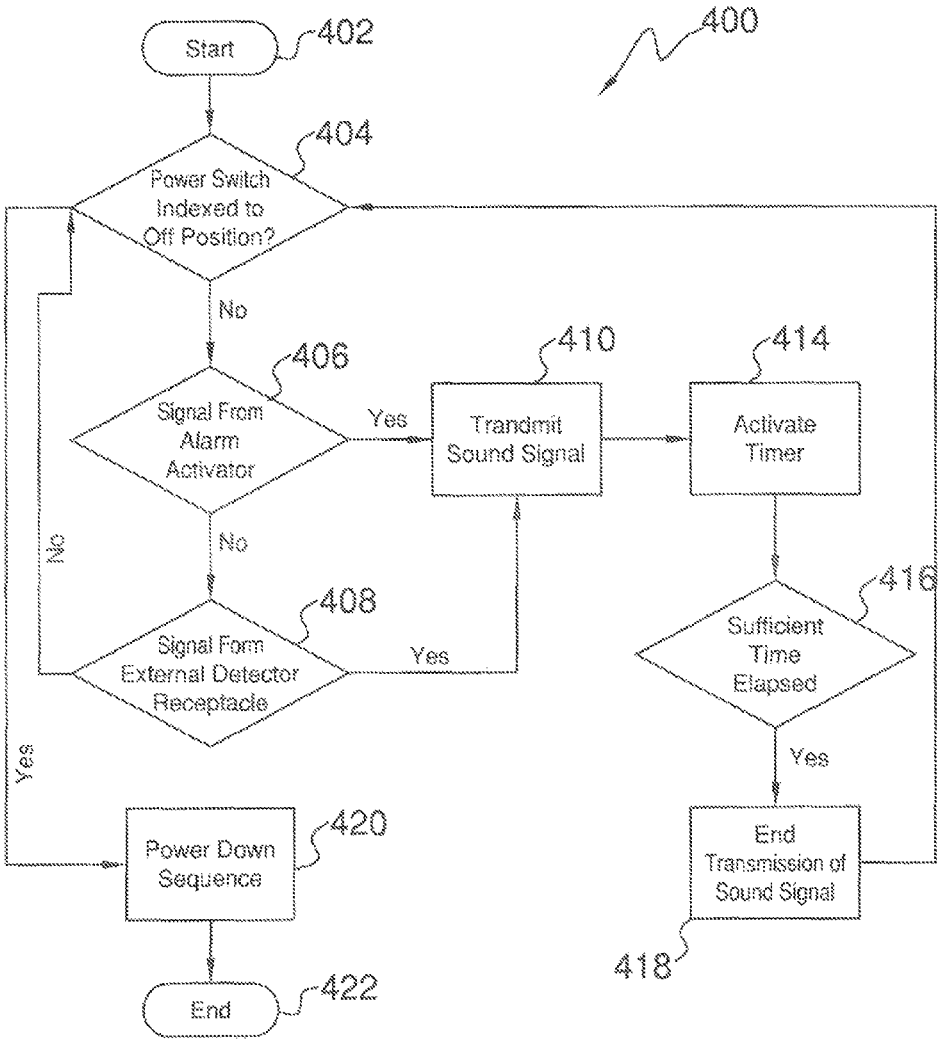
FIG. 4 is a schematic view of the operation of the system of the present invention.

The microprocessor 304 is programmed with software such as that depicted in FIG. 4 to, for example, control the activation and deactivation of the audible alarm. That is, the microprocessor 304 executes software that senses devices that are operatively coupled to the microprocessor 304 to determine if an alarm has been triggered by the alarm activator 104 or the external detector receptacle 106. In addition, the software executed by the microprocessor 304 may time and control the duration that the audible alarm is emitted by the system 100. Finally, the microprocessor 304 plays the audio file and transmits the played audio for amplification and emission by the system 100 as further described below.

In some embodiments, the alarm activator 104 is a momentary switch and is wired to a binary input that may have an open status or a closed status. However, other types of switches may be substituted without departing from the scope of the present invention. When the alarm activator 104 is depressed, the status of the binary input changes, which provides electrical signals to the microprocessor 304 to indicate that the alarm activator 104 has been depressed.

In some embodiments, the external detector receptacle 106 is a pull pin alarm activation mechanism, which includes a breakaway switch. However, other types of switches for reading an external detection device may be substituted without departing from the scope of the present invention. The external detector receptacle 106 is wired to a binary input that may have an open status or a closed status. When the pin is removed from the external detector receptacle 106, the status of the binary input changes, thereby indicating to the microprocessor 304 that the pin has been removed.

A memory component 306 (e.g., external memory) is operatively connected to the microprocessor 304. The memory component 306 may be any chip capable of retaining digital information as is commonly known in the art. For example, in some embodiments, the memory component 306 may comprise flash memory, random access memory (RAM), read-only memory (ROM), flash memory, EEPROM, etc. However, alternate forms of memory may be substituted such as a Smartcard, SmartMedia, Dual In-line Memory Modules, Single In-Line Memory Modules, etc. without departing from the scope of the present invention. The memory component 306 may contain one or more audio file(s) of a recording of a sound known to deter potential assailants, including, but not limited to, dogs barking and/or snarling. The recording may include multiple dogs barking and/or snarling in a defensive manner. In some embodiments, the audio file may include approximately thirty seconds of a recording of barking and/or snarling dogs followed by five seconds of silence. In the event that an audible alarm is required, the microprocessor 304 retrieves the audio file from the memory component 306 and plays the file via the audio output device 108 or external audio output receptacle 110. The played audio file may be a .wav file or similar audio file such as, but not limited to, .AIFF, .MP3, .ADPCM, or .GSM files.

In some embodiments, the system 100 comprises an amplifier 310 operatively connected to the microprocessor 304. The amplifier 310 is operatively connected to the audio output device 108 and the external audio output receptacle 110. In some embodiments, the audio is transmitted to amplifier 310 prior to audio output device 108 or external audio output receptacle 110. In some embodiments, the amplifier 310 is a transducer drive amplifier. However, other types of amplifiers may be substituted without departing from the scope of the present invention.

In some embodiments, the audio output device 108 includes a transducer that converts the electrical signals for the audio file to be emitted as sound waves by the audio output device 108 as commonly known in the art. The sound waves may be in the range audible to human beings or may be ultrasonic sound. Ultrasonic sound has a wave frequency of over 20,000 hertz and cannot be perceived by human beings as is commonly known in the art. However, many animals possess the capability to perceive sound in the ultrasonic range. Therefore, an appropriate sound clip in the ultrasonic range can be an effective deterrent against animal assailants. The amplifier 310 is also operatively coupled to external the audio output receptacle 110 and transmits the audio file thereto. In the event that an external speaker is coupled to the external audio output receptacle 110, the audio is transmitted to the external speaker for conversion to audible or ultrasonic sound.

Alternatively, in some embodiments, the system 100 may not include an external memory such as the memory component 306. Instead, the microprocessor 304 may include onboard memory containing the required audio file.

FIG. 4 depicts a flowchart of an example of a process 400 executed by the microprocessor 304 to control the emission of the audible alarm. Process 400 begins at step 402, at which the power switch 112 has been indexed to the on position. That is, the microprocessor 304 executes Process 400 when the user indexes the power switch 112 to the on position. In the depicted embodiment of the present invention, the power switch 112 is wired to a binary input and the microprocessor 304 reads the status of the binary input (e.g., open or closed) to determine whether the switch is in the on or off position. The microprocessor 304 will be programmed to recognize a closed binary input as "off" and an open binary input as "on" or vice versa. Next, Step 404 determines if the power switch 112 has been indexed to the off position. If Step 404 determines that the power switch 112 has been indexed to the off position, process 400 proceeds to Step 420 as further discussed below.

If, at Step 404, it is determined that the power switch 112 has not been indexed to the off position, Process 400 proceeds to Step 406, at which it is determined if an alarm signal is being transmitted. If an alarm signal is being transmitted by the alarm activator, then the system plays the audio file. The played audio may be any audio capable of deterring an attack including, but not limited to, the sound of barking dogs.

Process 400 then proceeds to Step 414, at which a timer is activated. The timer tracks the duration that the electronic sound signal has been transmitted to the amplifier 310, thereby tracking the duration that the audible alarm is emitted from the system 100. The duration of the timer is of sufficient length such as, but not limited to, two minutes, to effectively prevent an assailant from continuing to attack. In some embodiments, the two minutes includes thirty seconds of barking dogs followed by approximately five seconds of silence that is repeated three or four times for an approximate two minute duration. However, other durations of sound and/or silence may be substituted without departing from the scope of the present invention.

Next, at step 416, it is determined if sufficient time has elapsed since transmission of the electronic sound signal began. In some embodiments, to effectively deter an assailant from assaulting an individual or material goods or to stop an assailant after an assault has begun, the audible alarm must be emitted from the system 100 for a relatively long duration. That is, the duration of the audible alarm emitted from the system 100 must be of sufficient length to cause an individual assaulting a user of multi-function device 100 to realize that the alarm will continue to draw attention to their actions; cease their assault on the user; and move a sufficient distance away from the user. In the event that an animal attempts to assault an individual or material goods, initial emission of the audible alarm will startle and/or scare the animal causing it to cease the assault. However, continued emission of the audible alarm deters the animal from resuming the assault. In addition, as the animal retreats from the location of the system 100, the alarm will still be audible, causing further fear in the animal and further increasing the likelihood that the animal will not return and continue the assault at a later time.

Without wishing, to limit the present invention to any theory or mechanism, it is believed that in some embodiments it is advantageous for the audible alarm to be emitted for a relatively long duration so that other individuals in the vicinity will have sufficient time to react. For instance, in the event that a user is assaulted in a public place such as a park, other individuals in the surrounding vicinity that desire to assist the user may require continued emission of the audible alarm to locate the user. Alternatively, if a user sets multi-function protection device to protect material goods and those goods are assaulted, the extended duration of the audible alarm ensures the user will not miss hearing the audible alarm and will affirmatively be alerted to the potential damage to his or her possessions.

If step 416 determines that sufficient time has not elapsed, process 400 repeats step 416. In this manner, process 400 remains at step 416 until sufficient time has elapsed since transmission of played audio began. In the event that the microprocessor 304 plays the entire audio file(s) but sufficient time has not elapsed, the microprocessor 304 replays the audio file. In this manner, the microprocessor 304 plays the audio file in a loop until sufficient time has elapsed. In an alternative embodiment of the present invention, the duration of the audible alarm emitted by the system 100 may be determined by the duration of the audio file. In such an embodiment, the duration of the audio file itself times duration of the emission of the audible alarm. When it is determined that sufficient time has elapsed, process 400 proceeds to step 418, at which transmission of the played audio stops, thereby stopping emission of the audible alarm from the system 100.

Process 400 then returns to step 404 once again to determine if the power switch 112 has been indexed to the off position. If the answer is yes, process 400 proceeds to step 420, at which the microprocessor 304 enters a commonly known power down sequence. Such a sequence is typically provided by the manufacturer of the microprocessor. The process then terminates at step 422. It is worth noting that in the depicted embodiment of the present invention, if emission of the audible alarm has already commenced (e.g., process 400 has already proceeded to step 412 and begun playing the audio file), emission of the audible alarm is not immediately terminated upon indexing power switch 112 to the off position. That is, the system does not power down until after the timer elapses and transmission of the played audio terminates. This feature of the system 100 prevents an assailant from easily stopping emission of the audible alarm from the system 100 via indexing the power switch 112 to the off position. Also, upon realizing the audible alarm may not be stopped by turning the system 100 off, an assailant is more likely to eliminate his/her assault and retreat from the user. However, alternate embodiments of the present invention are envisioned in which indexing the power switch 112 to the off position immediately terminates emission of the audible alarm from the system 100.

Although the embodiment of the present invention depicted in FIG. 1-4 has been described with respect to its ability to protect a waste receptacle, the present invention may be used to describe other types of personal property including, without limitation, beverage coolers, grills, tents, gardens, sheds and other outbuildings, building entrances and fenced yards.

As used herein, the term "about" refers to plus or minus 10% of the referenced number.

The disclosures of the following U.S. Patents are incorporated in their entirety by reference herein: U.S. Design Pat. No. D527055; U.S. Pat. No. 7,173,534; U.S. Pat. Application No. 2007/0052536; U.S. Pat. Application No. 2009/0038663; U.S. Pat. Application No. 2009/0078216; U.S. Pat. Application No. 2009/0120374.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A protection system (100) for providing an alarm sound to deter an attack, said protection system (100) consisting of:

(a) a housing (102);

(b) an audio output device (108) disposed on the housing (102);

(c) an alarm activator (104) disposed on the housing (102), the alarm activator (104) can move between at least an inactive position and an active position;

(d) an external detector receptacle (106) disposed on the housing (102), the external detector receptacle (106) can move between an inactive state and an active state;

(e) an external audio output receptacle (110) disposed on the housing (102), the external audio output receptacle (110) functions to connect an external speaker and allows transmission of audio to the external speaker;

(f) a power switch (112) disposed on the housing (102), the power switch (112) can move between an on position and an off position respectively turning on and off the system (100);

(g) a power source (302) housed in a battery compartment (114) disposed in the housing (102);

(h) a microprocessor (304) operatively connected to each the alarm activator (104), the external detector receptacle (106), the audio output device (108), the power source (302), and the power switch (112);

(i) a memory component (306) operatively connected to the microprocessor (304), the memory component (306) consists of at least one audio file of a recording of a sound;

(j) a clip (206) disposed on the housing (102) consisting of a body (208) with a downwardly extending arm (210), wherein the body (208) consists of an upwardly facing surface (214) and a downwardly facing surface (216), wherein the upwardly facing surface (214) and the downwardly facing surface (210) consists of beveled edges at their outermost ends, wherein the clip (206) functions to facilitate attachment of the housing (102) to a person or an object; and (k) a bead (226) disposed at the bottommost end of the arm (210) facing the housing (102);

wherein when the alarm activator (104) is moved to the activated position the alarm activator (104) sends a first input signal to the microprocessor (304) whereupon the microprocessor sends a first output command to the audio output device (108) and the external audio output receptacle (110) causing the audio output device (108) and the external audio output receptacle (110) to emit the sound from the audio file of the memory component (306);

wherein when the external detector receptacle (106) is moved to the activated state the external detector receptacle (106) sends a second input signal to the microprocessor (304) whereupon the microprocessor sends the first output command to the audio output device (108) and the external audio output receptacle (110) causing the audio output device (108) and the external audio output receptacle (110) to emit the sound from the audio file of the memory component (306).

* * * * *